US011503908B2

(12) United States Patent
Duggins

(10) Patent No.: US 11,503,908 B2
(45) Date of Patent: Nov. 22, 2022

(54) BRACKET FOR DRAWER SLIDE

(71) Applicant: Tenn-Tex Plastics, Inc., Colfax, NC (US)

(72) Inventor: William Duggins, Kernersville, NC (US)

(73) Assignee: Tenn-Tex Plastics, Inc., Colfax, NC (US)

( * ) Notice: Subject to any disclaimer, the term of this patent is extended or adjusted under 35 U.S.C. 154(b) by 0 days.

(21) Appl. No.: 17/206,453

(22) Filed: Mar. 19, 2021

(65) Prior Publication Data

US 2021/0345774 A1 Nov. 11, 2021

Related U.S. Application Data

(60) Provisional application No. 63/021,132, filed on May 7, 2020.

(51) Int. Cl.
*A47B 88/43* (2017.01)
*A47B 88/407* (2017.01)

(52) U.S. Cl.
CPC ..... *A47B 88/43* (2017.01); *A47B 88/407* (2017.01)

(58) Field of Classification Search
CPC ..... A47B 88/43; A47B 88/407; A47B 88/423
See application file for complete search history.

(56) References Cited

U.S. PATENT DOCUMENTS

| | | | | |
|---|---|---|---|---|
| 5,359,752 | A * | 11/1994 | Domenig | A47B 88/43 312/334.5 |
| 8,911,037 | B2 * | 12/2014 | Hightower | A47B 88/43 312/334.5 |
| 9,549,613 | B2 * | 1/2017 | Hightower | A47B 88/43 |
| 2011/0234072 | A1 * | 9/2011 | Hightower | A47B 88/43 312/334.8 |
| 2015/0082597 | A1 * | 3/2015 | Hightower | A47B 88/423 29/408 |
| 2021/0212460 | A1 * | 7/2021 | Chen | A47B 88/423 |
| 2021/0321766 | A1 * | 10/2021 | Duggins | A47B 88/43 |

* cited by examiner

*Primary Examiner* — Eret C McNichols
(74) *Attorney, Agent, or Firm* — Myers Bigel, P.A.

(57) ABSTRACT

An undermount slide bracket includes: a vertical panel with upper and lower edges; a nub extending from a first side of the vertical panel; a horizontal floor fixed relative to the vertical panel; and two pairs of wings extending forwardly from the floor, each pair of wings extending laterally in opposite directions from a foundation, the pairs of wings being arranged in stacked, spaced apart relationship, such that a gap is formed between vertically adjacent wings. The foundation has an alternating series of ribs and recesses.

17 Claims, 8 Drawing Sheets

BRACKET FOR DRAWER SLIDE

FIELD OF THE INVENTION

The present application claims priority from and the benefit of U.S. Provisional Patent Application No. 63/021,132, filed May 7, 2020, the disclosure of which is hereby incorporated by reference herein in full.

FIELD OF THE INVENTION

The present invention is directed generally to furniture, and more particularly to cabinets with sliding drawers and trays.

BACKGROUND OF THE INVENTION

Many cabinets, particularly those found in kitchens, include drawers for storing various items. Often, drawers are mounted to the cabinet with elongate drawer slides that are fixed to the drawer. Each drawer slide has a slide member fixed to the drawer that slidably engages a stationary member that is fixed to the walls or face frame of the cabinet (often either the slide member or the stationary member includes a small wheel that facilitates sliding motion). Some of such cabinets include multiple drawers, which can be disposed in vertically stacked fashion, side-by-side fashion, or both.

Some drawers have slides that are mounted on the underside of the drawer (so-called "undermounted" drawer slides). These drawer slides may be preferred in some environments because they are less exposed than side-mounted drawer slides and therefore may be less exposed to damage) and may avoid taking up space on either side of the drawer. In some embodiments, undermounted slides may have mechanisms that cause the drawer to close automatically without slamming. An exemplary undermounted drawer slide is the DYNAMIC NT slide, available from Mepla-Alfit, Reinheim, Germany; another is illustrated in U.S. Pat. No. 6,854,817 to Simon.

An undermounted drawer slide may be mounted to a side wall of the cabinet, or may be mounted at either end to the front or rear wall. If the slide is to be mounted to the front or rear wall, often the wall will include mounting holes for receiving screws or other fasteners inserted through a mounting bracket that connects to the slide. However, the tolerances of cabinets and drawer slides are typically insufficiently precise to consistently position the holes in the mounting bracket for easy mounting of the drawer slide. Also, some currently popular cabinets have drawers that are configured such that, when the drawer is closed, the front face of the drawer is substantially flush with the front face of the cabinet. In such instances, it is typically desirable that the drawer be mounted precisely to ensure the flush relationship of the drawer face and cabinet face. However, achieving a flush relationship may be difficult due to inconsistencies in the thickness of the drawer face, the length of the cabinet and drawer slides, and the thickness of the front wall of the cabinet. Examples of systems that can help to address these issues are shown in U.S. Pat. No. 8,911,037, the disclosure of which is hereby incorporated herein in full by reference.

In view of the foregoing, it may be desirable to provide improved components that expand on this mounting technique.

SUMMARY

As a first aspect, embodiments of the invention are directed to an undermount slide bracket. The bracket comprises: a vertical panel with upper and lower edges; a nub extending from a first side of the vertical panel; a horizontal floor fixed relative to the vertical panel; and two pairs of wings extending forwardly from the floor, each pair of wings extending laterally in opposite directions from a foundation, the pairs of wings being arranged in stacked, spaced apart relationship, such that a gap is formed between vertically adjacent wings. The foundation has an alternating series of ribs and recesses.

As a second aspect, embodiments of the invention are directed to an undermount slide bracket comprising: a vertical panel with upper and lower edges; a nub extending from a first side of the vertical panel; a horizontal floor fixed relative to the vertical panel; and two pairs of wings extending forwardly from the floor, each pair of wings extending laterally in opposite directions from a foundation, the pairs of wings being arranged in stacked, spaced apart relationship, such that a gap is formed between vertically adjacent wings. The foundation has an alternating series of ribs and recesses. The undermount slide bracket is formed of a polymeric material.

As a third aspect, embodiments of the invention are directed to a method of forming an undermount slide bracket. The method comprises the steps of:

(a) providing first and second mold halves with respective first and second cavities;

(b) moving the first mold half relative to the second mold half in a first direction so that the first and second cavities form a piece cavity;

(c) injecting polymeric material into the piece cavity to form an undermount slide bracket, the undermount slide bracket comprising:

a vertical panel with upper and lower edges;

a nub extending from a first side of the vertical panel;

a horizontal floor fixed relative to the vertical panel;

two pairs of wings extending forwardly from the floor, each pair of wings extending laterally in opposite directions from a foundation, the pairs of wings being arranged in stacked, spaced apart relationship, such that a gap is formed between vertically adjacent wings;

wherein the foundation has an alternating series of ribs and recesses; and (d) moving the first mold half in a second direction opposite the first direction to remove the undermount slide bracket, the removal of the undermount slide bracket not requiring movement of any portion of the first mold half in a direction perpendicular to the first and second directions.

DETAILED DESCRIPTION

Figure 1:
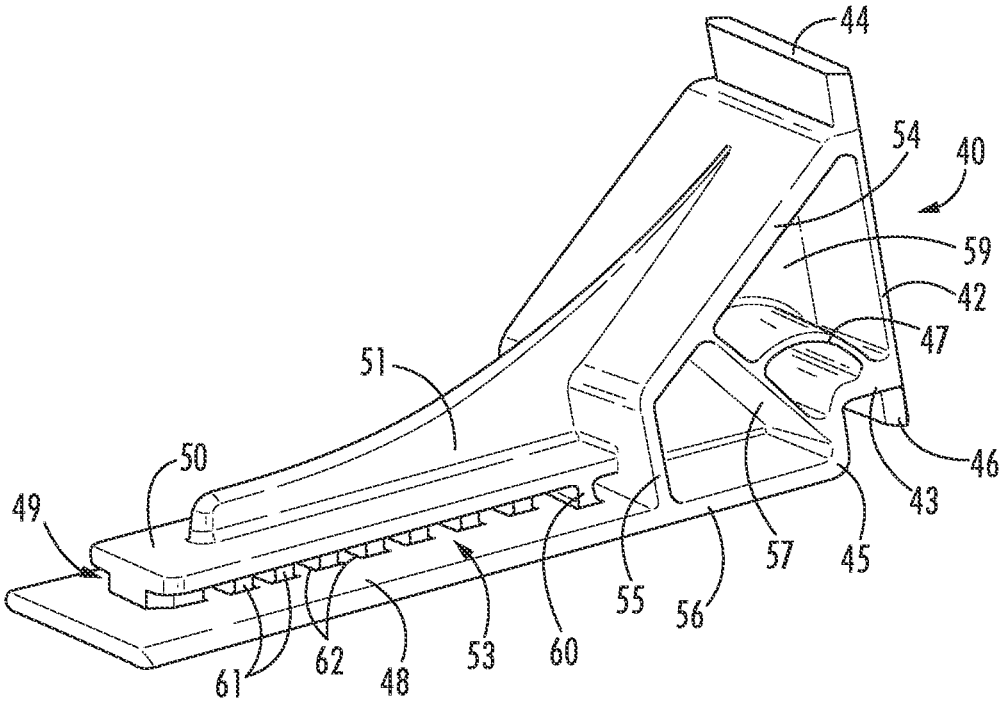
FIG. 1 is a front perspective view of an undermount slide bracket useful in mounting drawer slides in cabinets according to embodiments of the invention.
Figure 2:
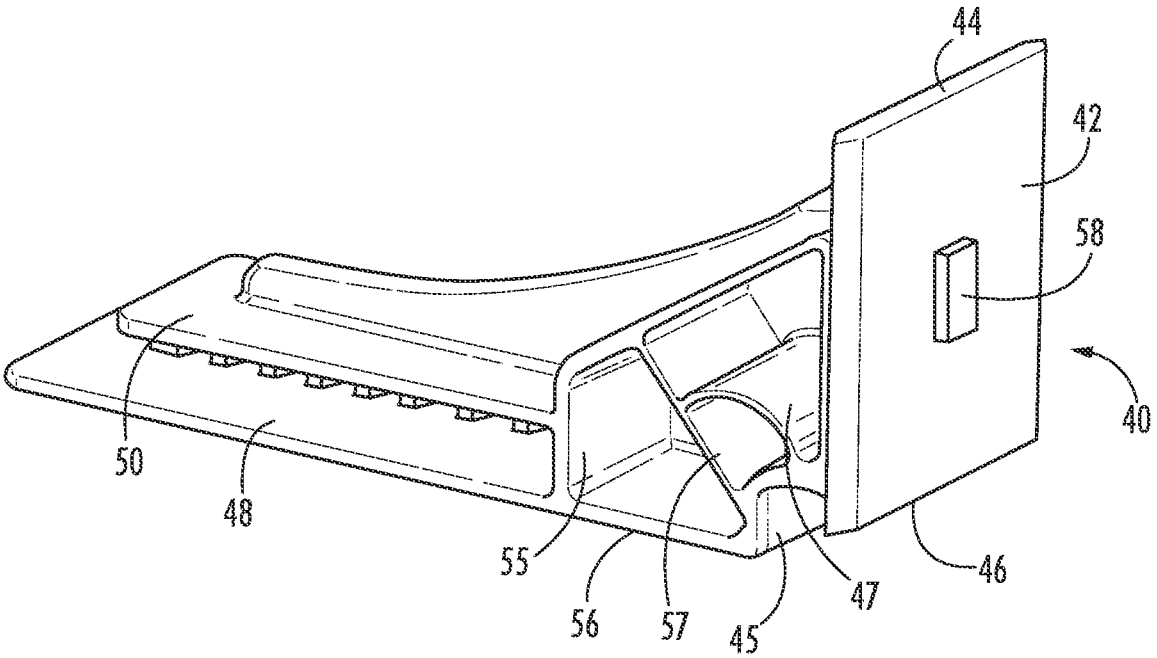
FIG. 2 is a rear perspective view of the bracket of FIG. 1.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms comprises and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

Referring now to the drawings, an undermount slide bracket, designated broadly at 40, is shown in FIGS. 1-4. The undermount slide bracket 40 has a vertical panel 42 that extends downwardly to a shelf 43. The shelf 43 extends forwardly to a lower panel 45. The vertical panel 42 includes an upper edge 44 and a lower edge 46. A rear nub 58 extends from the rear surface of the vertical panel 42.

A sloping panel 54 extends forwardly and downwardly from an upper section of the vertical panel 42. A stop panel 55 extends downwardly therefrom to a floor 56 that merges at its rear end with the lower panel 45. On each side of the bracket 40, a brace 57 extends from the sloping panel 54 to the lower panel 45, and an arcuate support 47 extends between the brace 57 and the shelf 43. The brace 57 and support 47 extend inwardly on each side to meet a vertical divider panel 59 that spans the vertical panel 42, the shelf 43, the lower panel 45, the stop panel 55, the sloping panel 54 and the floor 56.

Two pairs of wings (lower wings 48 and upper wings 50) extend forwardly from the lower panel 45. The lower wings 48 extend forwardly from the lower edge of the lower panel 45 and are generally coplanar with the floor 56. The upper wings 50 extend forwardly from the stop panel 55 and are parallel with the lower wings 48. The wings 48, 50 are "stair-stepped", such that the lower wings 48 extend forwardly and laterally slightly farther than do the upper wings 50. The individual wings 48, 50 of each pair are separated from each other by a foundation 53, such that a gap or slot 49 is present between respective adjacent lower and upper wings 48, 50. A long, sloping central rib 51 divides the wings 48, 50 and extends upwardly from the upper wings 50.

Figure 3:
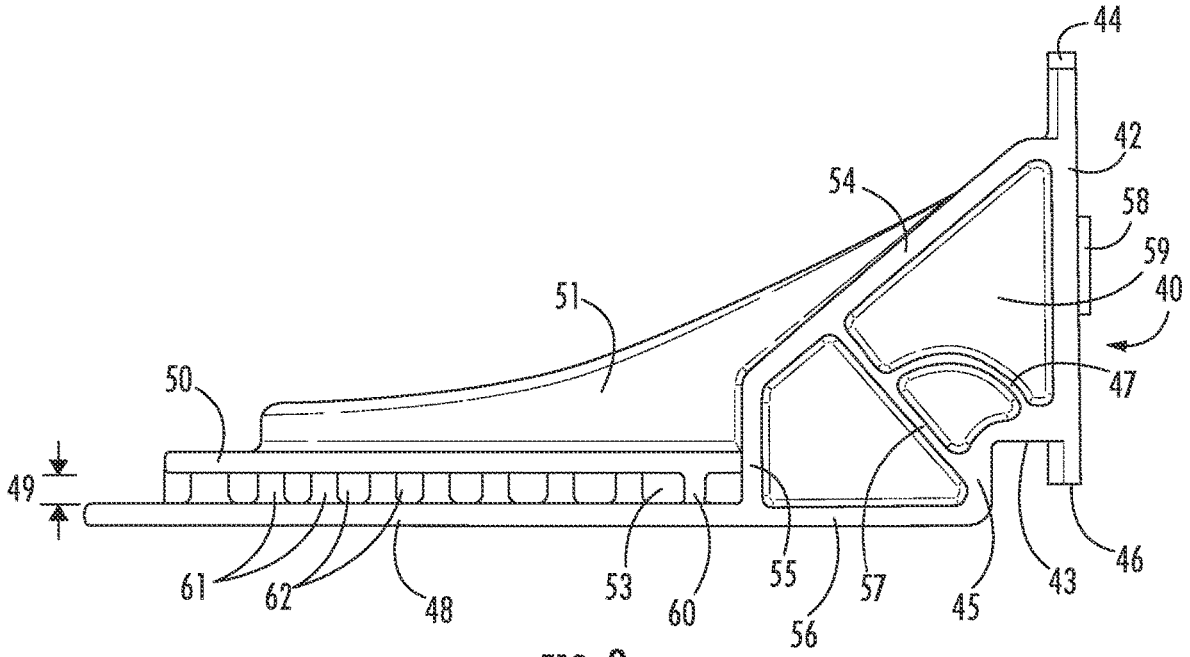
FIG. 3 is a side view of the bracket of FIG. 1.
Figure 4:
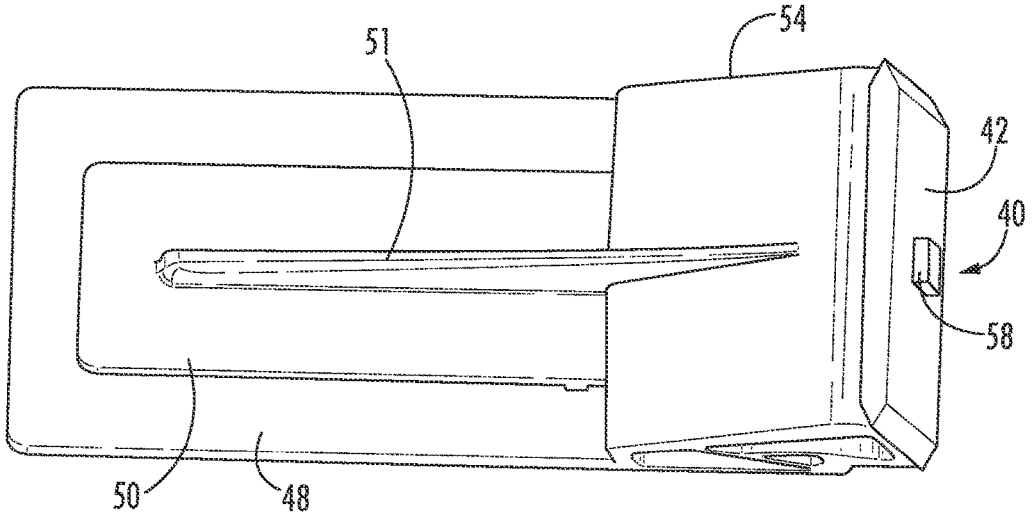
FIG. 4 is a top perspective view of the bracket of FIG. 1.
Figure 5:
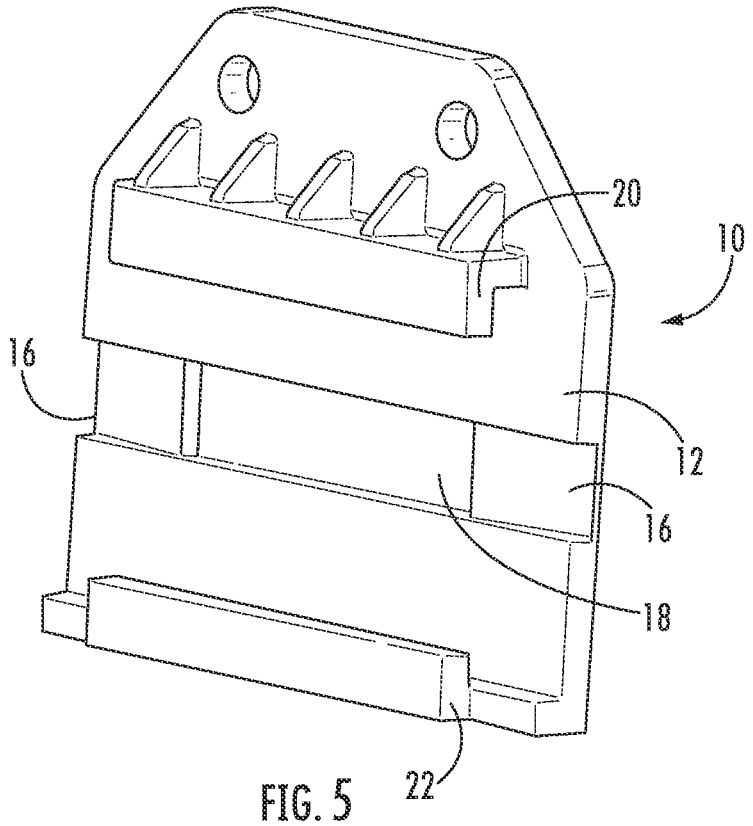
FIG. 5 is a front perspective view of a mounting bracket that can be used with the undermount slide bracket of FIG. 1.

As seen in FIGS. 1 and 3, a stop 60 is present in each of the gaps 49 between the lower and upper wings 48, 50 near the stop panel 55. In some embodiments, more or fewer stops may be included or their locations may change. Notably, the foundation 53 includes an alternating series of ribs 61 and recesses 62, which gives the foundation 53 a "honeycomb" appearance when viewed from the side.

The ribs 61 and recesses 62 may be present to facilitate manufacturing of the bracket 40. More specifically, the bracket 40 is typically formed of a thermoplastic polymeric material, and is typically injection-molded. Many thermoplastic materials have shrinkage characteristics that cause molten material to shrink differentially based on the thickness of the material. Such shrinkage can cause parts to warp as they cool and/or can cause voids in the parts. As such, designers are typically encouraged to design parts with relatively thin and consistent wall thickness. In addition, the molding of thermoplastic parts can be simplified by designing the parts so that they can be formed in a mold that, when separated, all of the components of the mold halves draw directly away from each other along a direction of separation; there are no "slide/camactions" in the mold that retract in a direction perpendicular to the direction of separation. The presence of the honeycomb structure of ribs 61 and recesses 62 can enable the bracket 40 to be formed with acceptable wall thicknesses (i.e., there are no overly thick areas that could cause problems due to sink characteristics), while still being moldable without slide/cam-actions in the mold (i.e., the mold halves are devoid of slide/cam-action mechanisms).

The use of the undermount slide bracket 40 can be understood by reference to FIGS. 5-8. As described in detail in U.S. Pat. No. 8,911,037, supra, a mounting bracket 10 (shown in FIG. 5) includes a main panel 12. An L-shaped upper flange 20 projects from the front side of the main panel 12 and extends downwardly, and another L-shaped lower flange 22 projects from the front side of the main panel and extends upwardly. An access ramp 16 leads from each edge of the main panel 12 toward the center thereof. The access ramps 16 lead to a rectangular recess 18 that extends horizontally between the upper and lower flanges 20, 22. The inwardmost portion of the access ramps 16 juts forwardly (i.e., toward the front surface of the main panel 12), with the result that the recess 18 is bounded on all sides: on two sides by the main panel 12, and on the third and fourth sides by the inwardmost portions of the access ramps 16.

Figure 8:
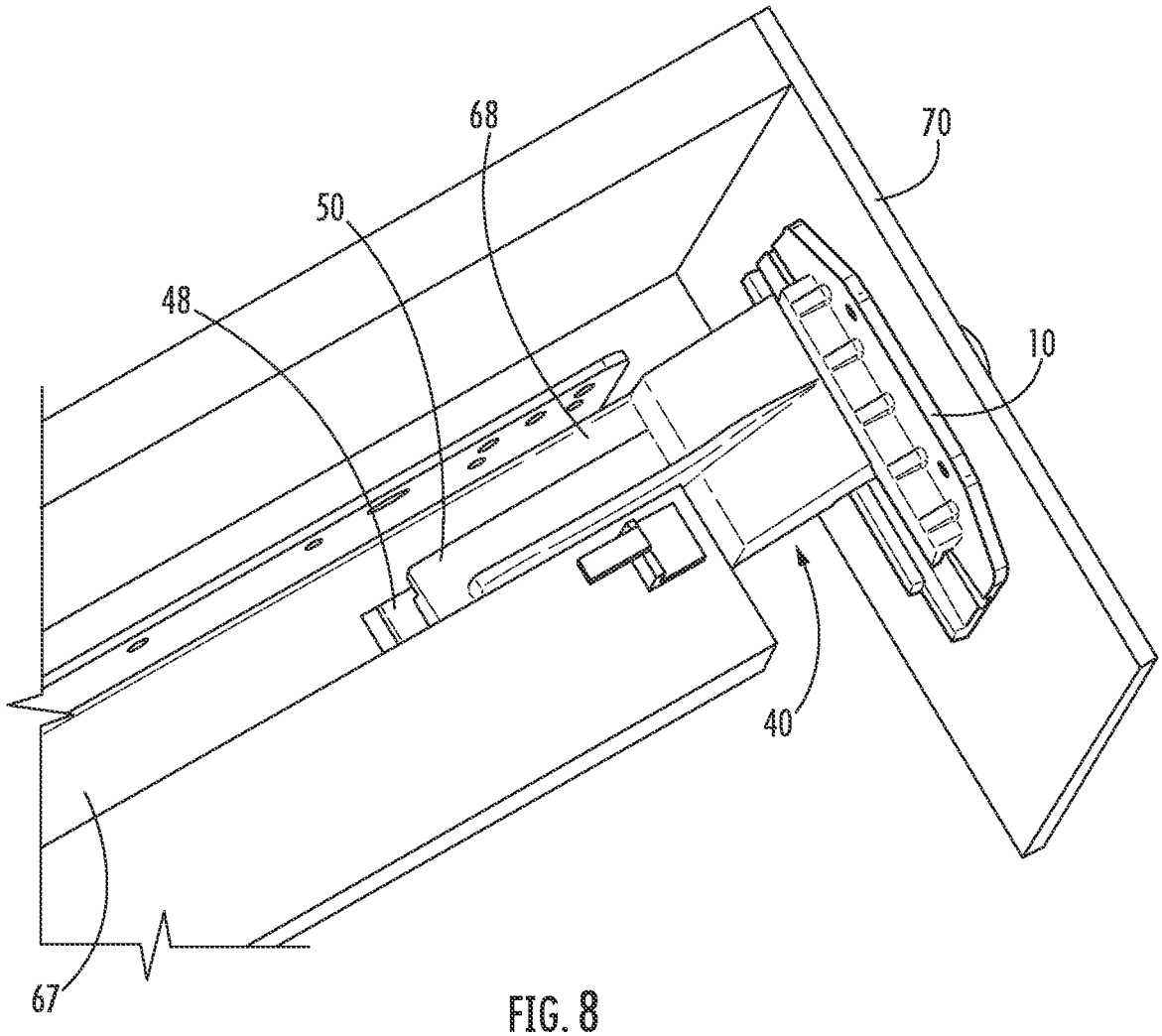
FIG. 8 is a front perspective view of the undermount slide bracket of FIG. 1 mounted on a bracket of FIG. 5, which is in turn mounted to the rear wall of a cabinet, wherein a drawer slide is being inserted into the lower gap or slot of the undermount slide bracket.
Figure 9:
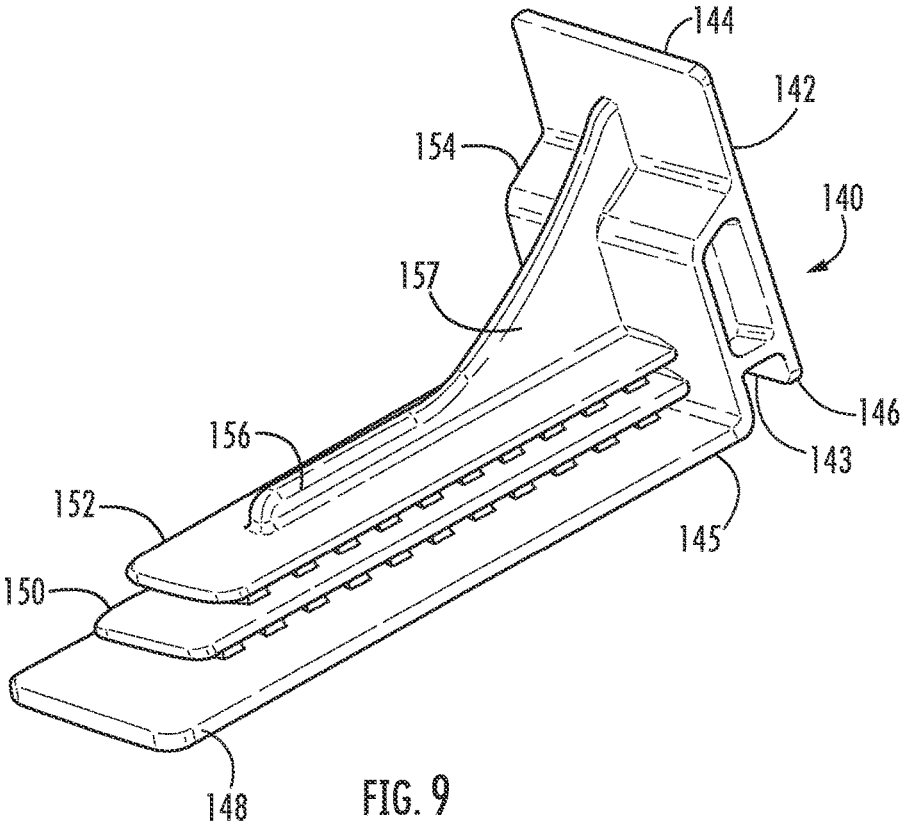
FIG. 9 is a front perspective view of an undermount slide bracket useful in mounting drawer slides in cabinets according to embodiments of the invention.
Figure 10:
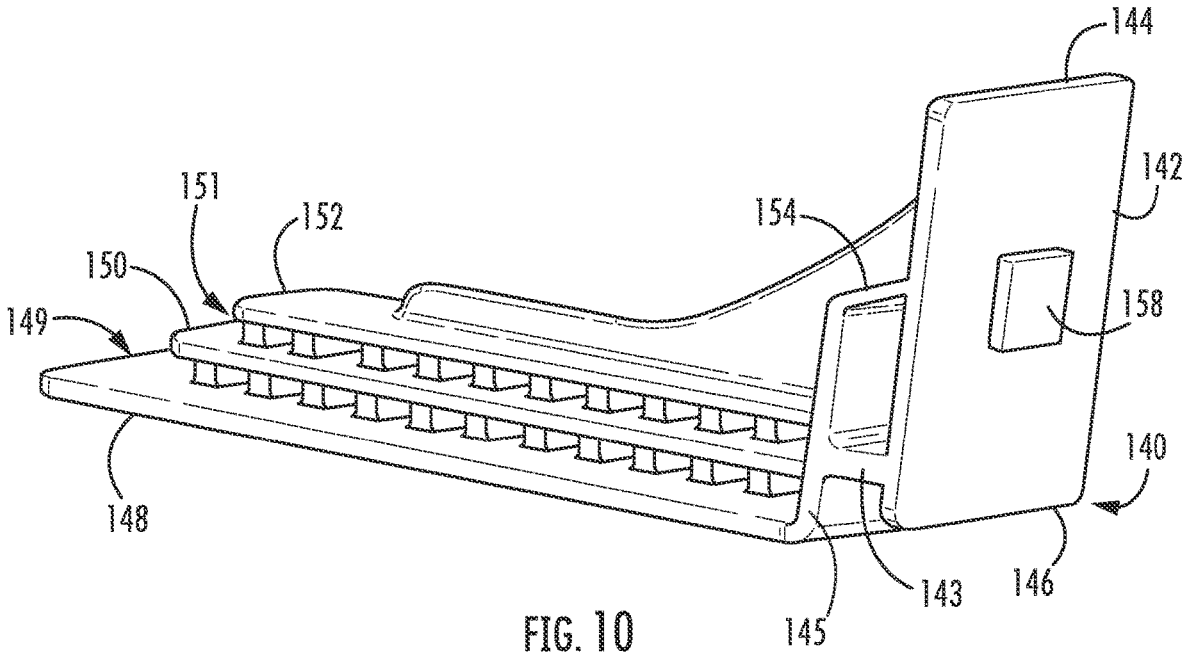
FIG. 10 is a rear perspective view of the bracket of FIG. 9.
Figure 11:
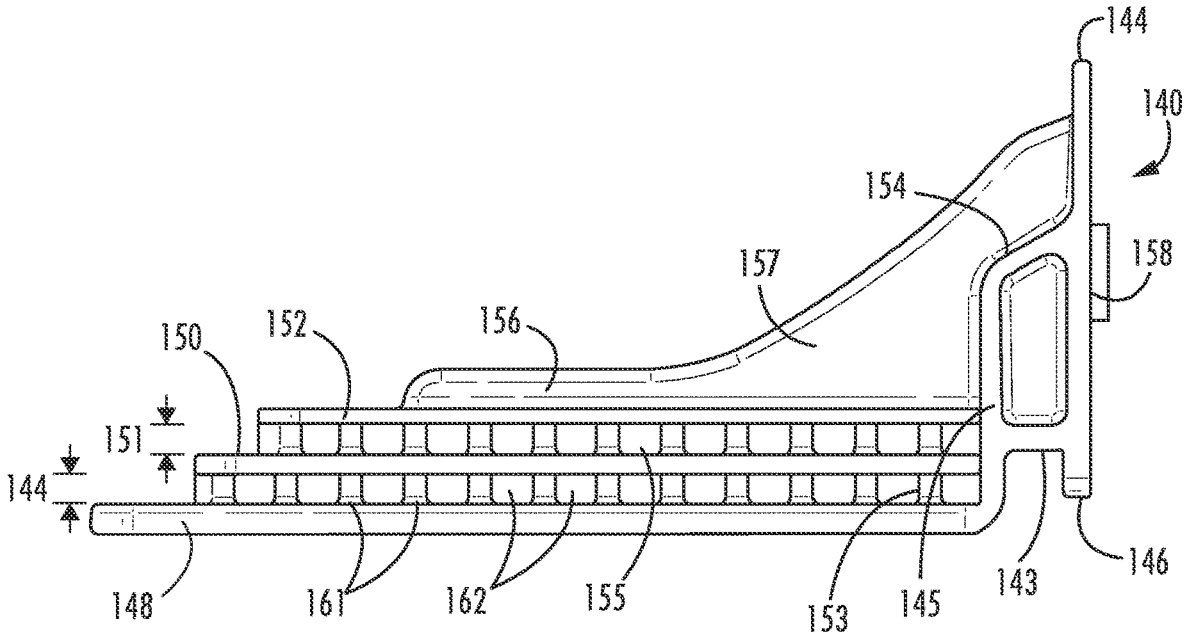
FIG. 11 is a side view of the bracket of FIG. 9.
Figure 12:
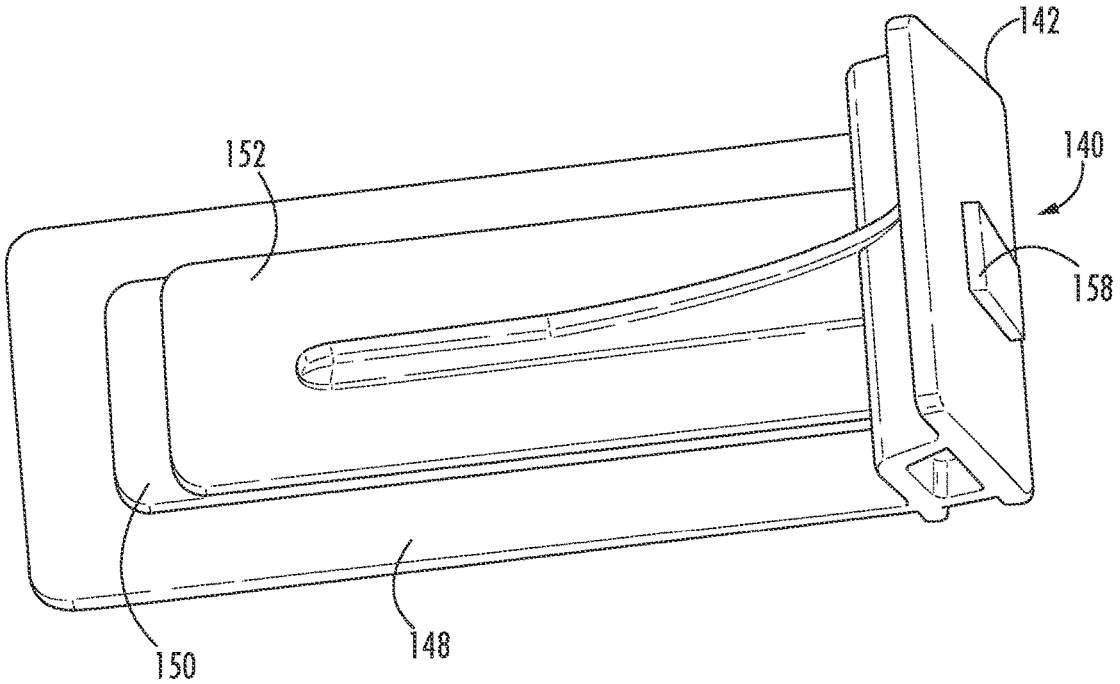
FIG. 12 is a top perspective view of the bracket of FIG. 9.

The back side of the main panel 12 may include features, such as split dowels, that enable the bracket 10 to be mounted to a rear cabinet wall 70 (FIG. 8). In other embodiments, holes in the main panel 12 may receive screws for mounting the bracket 10 to the wall 70.

The mounting bracket 10 is typically of unitary construction, but may be formed of multiple components if desired. The mounting bracket 10 may be formed of any material suitable for the mounting of drawer slides; a polymeric material, such as ABS, is typically employed.

Figure 6:
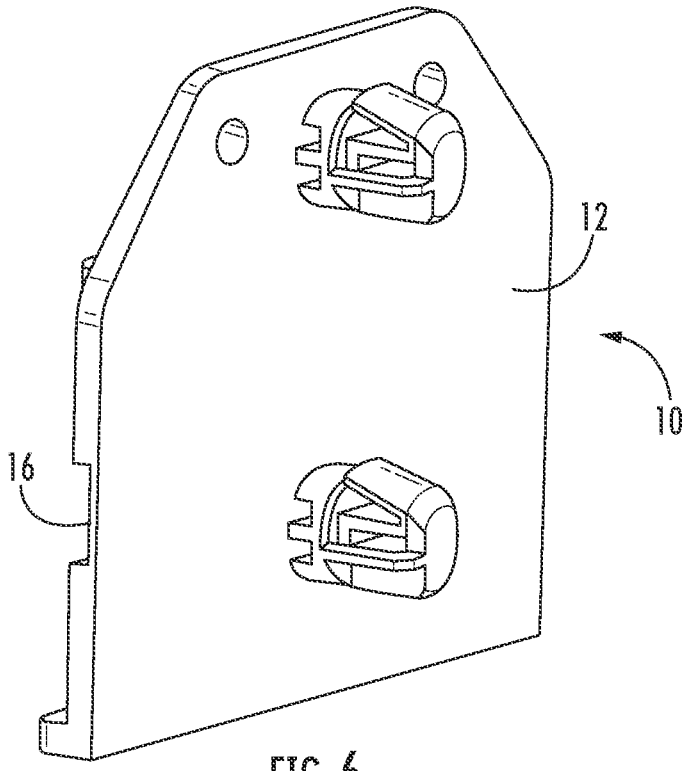
FIG. 6 is a rear perspective view of the mounting bracket of FIG. 5.
Figure 7:
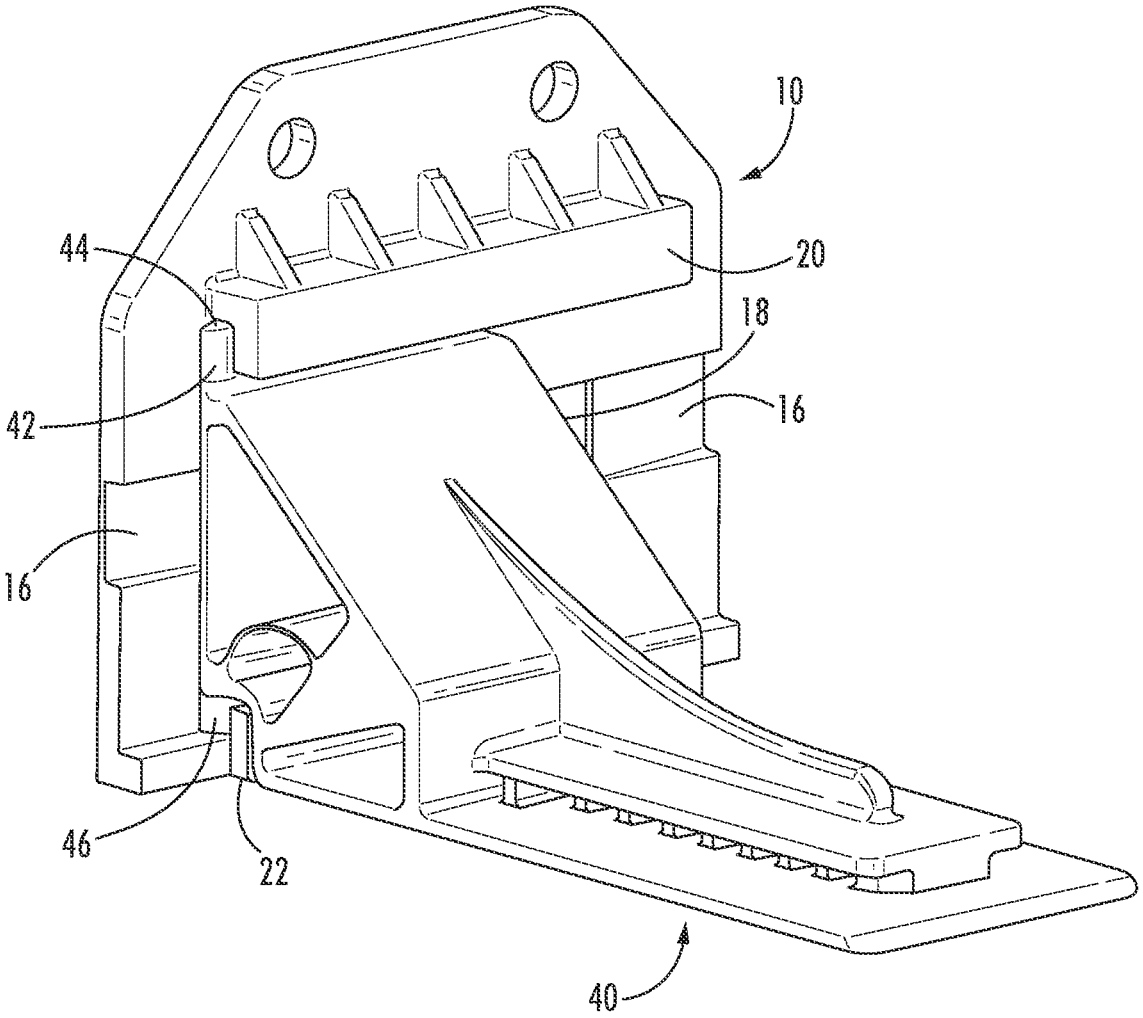
FIG. 7 is a front perspective view of the undermount slide bracket of FIG. 1 mounted on the mounting bracket of FIG. 5.

As can be seen in FIGS. 7 and 8, interconnection of the mounting bracket 10 and the undermount slide bracket 40 is accomplished by sliding the upper edge 44 of the vertical panel 42 into the pocket created by the upper flange 20, and by sliding the lower edge 46 of the vertical panel 42 into the pocket created by the lower flange 22 (FIG. 6). When so positioned, the rear nub 58 is received in one of the access ramps 16 in the main panel 12. The undermount slide bracket 40 is then slid toward the center of the mounting bracket 10 until the rear nub 58 is received in and captured by the rectangular recess 18. Once the nub 58 is positioned within the recess 18, the undermount slide bracket 40 is free to slide horizontally relative to the main panel 12 until the nub 58 strikes either of the side edges of the recess 18. Thus, the position of the undermount slide bracket 40 relative to the mounting bracket 10 can be adjusted.

Referring still to FIG. 8, once the mounting bracket 10 and undermount slide bracket 40 have been mounted to the cabinet wall 70 (typically by the manufacturer), a drawer slide 67 can be mounted to the undermount slide bracket 40. Typically, the drawer slide 67 will not already be attached to the underside of a drawer, although this need not be the case. Mounting is achieved by sliding lips 68 that define a slot in the drawer slides 67 into the gap 49 between wings 48, 50 of the undermount slide bracket 40. Notably, because the undermount slide bracket 40 is free to slide horizontally relative to the mounting bracket 10, the horizontal position of the undermount slide bracket 40 can be adjusted so that the drawer slide 67 can be received more readily and easily even if the drawer slide 67 is already mounted to the drawer.

Because the stops 60 are present between vertically adjacent wings 48, 50, they can ensure that the slides 67 of the same drawer are positioned similarly within the undermount slide bracket 40. Also, the presence of the stops 60 at the same location on each side of the undermount slide bracket 40 can ensure that each drawer slide 67 is oriented correctly relative to the undermount slide bracket 40 (i.e., the drawer slide 67 is not canted or tilted to the left or right) for proper mounting on the front of the cabinet. The variable position of the stops 60 allows various lengths and/or manufactured drawer slides 67 to be installed into various cabinet depths and styles. This allows different cabinet manufacturers to install the drawer slide 67 easily and quickly with the correct slide manufacturer's recommended set back location from the face frame or frameless cabinet. The stop 60 can also keep positive contact and/or pressure of the mounted slide to the cabinet's rear wall, which can keep the assembled bracket 10 from possibly falling out of the rear cabinet panel. This concept is discussed in more detail in U.S. Provisional Patent Application No. 63/011,773, filed Apr. 17, 2020, the disclosure of which is hereby incorporated herein by reference in full.

It should also be noted that the dimensions of the upper and lower edges 44, 46 of the undermount slide bracket 40, the upper and lower flanges 20, 22, and/or the nub 58 may be selected so that there is some frictional resistance to horizontal movement of the nub 58 within the recess 18. Such frictional resistance can limit unwanted horizontal movement, such that once the position of the undermount slide bracket 40 has been adjusted, the undermount slide bracket 40 remains in place and provides stable mounting to the drawer slide 67.

It should be noted that the bracket 10 may take a large variety of different configurations, particularly on the rear side of the main panel 12, that enable the bracket 10 of choice to be used with a particular cabinet wall 70. Generally speaking, manufacturers of cabinets often employ several different hole patterns for mounting of the bracket 10. Virtually any of the brackets 10 that may be employed with such a cabinet may be used with the undermount slide brackets 40 described herein. As a result, "mixing and matching" of the combination of the brackets 10, the undermount slide brackets 40, and the drawer slides 67 is facilitated by the versatility of the undermount slide bracket 40.

An alternative undermount slide bracket, designated broadly at 140, is shown in FIGS. 9-12. The undermount slide bracket 40 has a vertical panel 142 that extends downwardly to a shelf 143. The shelf 143 extends forwardly to a vertical stop panel 145. The vertical panel 142 includes an upper edge 144 and a lower edge 146. A rear nub 158 extends from the rear surface of the vertical panel 142. A sloping panel 154 extends from the upper edge of the stop panel 145 to the vertical panel 142.

Three sets of wings lower wings 148, intermediate wings 150, and upper wings 152) extend forwardly from the stop panel 145. The wings 148, 150, 152 are "stair-stepped", such that the intermediate wings 150 extend forwardly slightly farther than do the upper wings 152, and the lower wings 148 extend forwardly slightly farther than do the intermediate wings 150. The strata of wings 148,150, 152 are separated from each other by foundations 153, 155, which create gaps 149, 151 between respective pairs of wings 148, 150, 152. The height of the gaps 149, 151 can be varied, but in some embodiments is between about 0.25 and 0.25 inches. It can also be seen in FIG. 11 that the intermediate and upper wings 150, 152 may be narrower in width than the lower wings 148. The foundations 153, 155 each include a series of alternating ribs and recesses 161, 162.

A central rib 156 divides the wings 148, 150, 152 and extends upwardly from the upper wings 152. The rib 156 includes a triangular gusset 157 that extends rearwardly to the front surface of the vertical panel 142 and stop panel 145, although in other embodiments the gusset 157 may extend farther forwardly, or may be omitted entirely.

Figure 13:
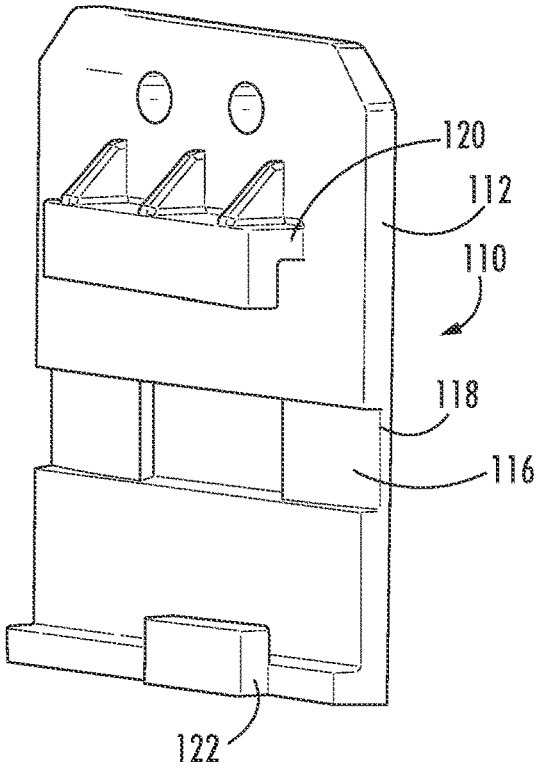
FIG. 13 is a front perspective view of a mounting bracket that can be used with the undermount slide bracket of FIG. 9.
Figure 14:
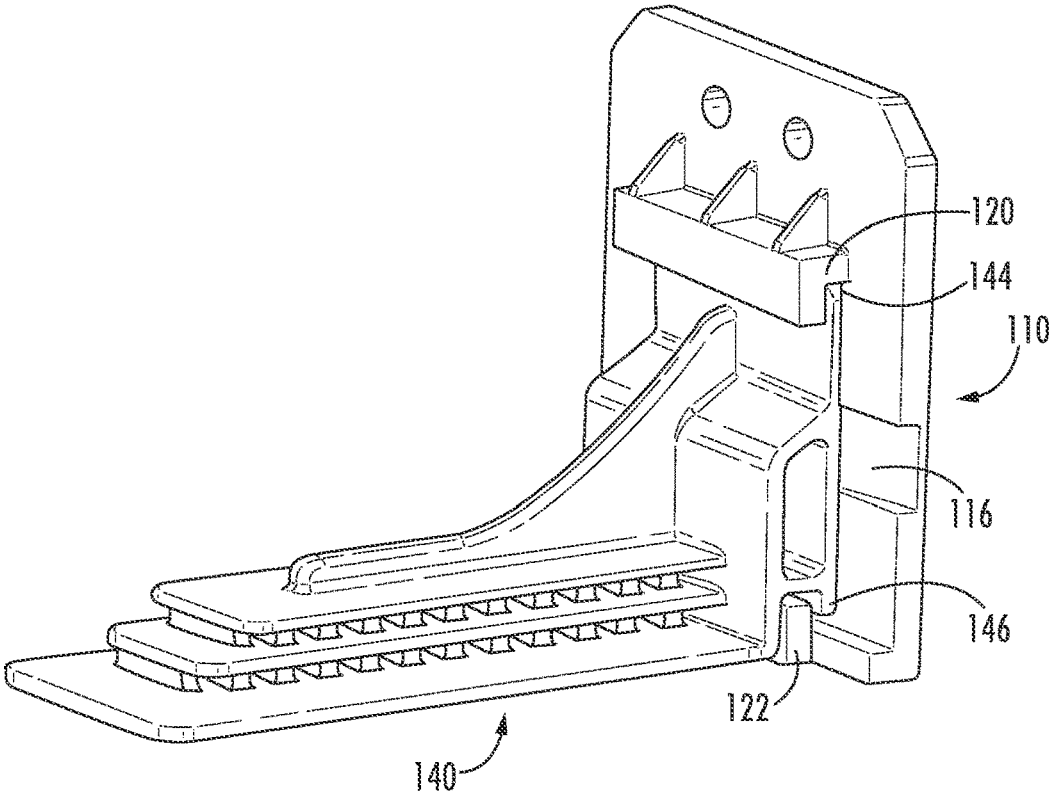
FIG. 14 is a front perspective view of the undermount slide bracket of FIG. 9 mounted on the mounting bracket of FIG. 13.

The use of the undermount slide bracket 40 can be understood by reference to FIGS. 13 and 14. As described in detail in U.S. Pat. No. 8,911,037, supra, a mounting bracket 110 (shown in FIG. 13) includes a main panel 112. An L-shaped upper flange 120 projects from the front side of the main panel 112 and extends downwardly, and another L-shaped lower flange 122 projects from the front side of the main panel and extends upwardly. An access ramp 116 leads from one edge of the main panel 112 toward the center thereof. The access ramp 116 leads to a rectangular recess 118 that extends horizontally between the upper and lower flanges 120, 122. The inwardmost portion of the access ramp 116 juts forwardly (i.e., toward the front surface of the main panel 112), with the result that the recess is bounded on all sides: on three sides by the main panel 112, and on the fourth side by the inwardmost portion of the access ramp 116.

The back side of the main panel 112 may include features, such as split dowels, that enable the bracket 110 to be mounted to a rear cabinet wall. In other embodiments, holes in the main panel 112 may receive screws for mounting the bracket 110 to the wall.

The undermount slide bracket 140 can be attached to the mounting bracket 110 in a similar manner to that described above for the undermount slide bracket 40 and the mounting bracket 10. The upper and lower edges 144, 146 of the undermount slide bracket 140 are inserted into the upper and lower flanges 120, 122, and the undermount slide bracket 140 is advanced sideways, with the nub 158 traveling up the access ramp 116 and being captured in the recess 118.

It should be noted that, like the undermount slide bracket 40, the undermount slide bracket 140 can also be injection molded without any "slide/cam actions" in the mold halves that can increase complexity, and therefore expense, of the mold.

It should also be noted that, although the undermount slide brackets 40, 140 is illustrated herein, other varieties of undermount slide brackets that are suitable for mounting of undermount drawer slides may also be employed.

Those skilled in this art will appreciate that the undermount slide brackets 40, 140 may take different configuration. For example, each may have more or fewer wings. The transition between the main panel and the floor may differ (e.g., the lower panel and shelf may be omitted). The support structure provided by the brace and arcuate support on the bracket 40 may differ or be omitted, or additional braces (such as a rib between the main and stop panels of the bracket 140) may be included. Other configurations may also be suitable.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An undermount slide bracket, comprising:
a vertical panel with upper and lower edges;
a nub extending from a first side of the vertical panel;
a horizontal floor fixed relative to the vertical panel;
two pairs of wings extending forwardly from the floor, each pair of wings extending laterally in opposite directions from a foundation, the pairs of wings being arranged in stacked, spaced apart relationship, such that a gap is formed between vertically adjacent wings;
wherein the foundation has an alternating series of parallel ribs and recesses.

2. The undermount slide bracket defined in claim 1, further comprising a shelf extending from a second, opposed side of the panel; and a lower panel extending downwardly from the shelf that merges with the floor.

3. The undermount slide bracket defined in claim 1, wherein the floor is coplanar with a lowermost pair of the wings.

4. The undermount slide bracket defined in claim 1, wherein the gap is between about 0.025 and 0.25 inches in height.

5. The undermount slide bracket defined in claim 1, wherein a lowermost pair of the wings extends farther laterally than an uppermost pair of the wings.

6. The undermount slide bracket defined in claim 3, wherein a lower surface of the foundation is coplanar with the lowermost pair of wings and is flat and devoid of upwardly-directed recesses.

7. The undermount slide bracket defined in claim 2, further comprising a sloping panel that extends forwardly and downwardly from the vertical panel and a stop panel that extends from the sloping panel to the floor.

8. The undermount slide bracket defined in claim 7, further comprising a brace extending between the sloping panel and the lower panel.

9. An undermount slide bracket, comprising:
a vertical panel with upper and lower edges;
a nub extending from a first side of the vertical panel;
a horizontal floor fixed relative to the vertical panel;
two pairs of wings extending forwardly from the floor, each pair of wings extending laterally in opposite directions from a foundation, the pairs of wings being arranged in stacked, spaced apart relationship, such that a gap is formed between vertically adjacent wings;
wherein the foundation has an alternating series of parallel ribs and recesses; and
wherein the undermount slide bracket is formed of a polymeric material.

10. The undermount slide bracket defined in claim 9, further comprising a shelf extending from a second, opposed side of the panel; and a lower panel extending downwardly from the shelf that merges with the floor.

11. The undermount slide bracket defined in claim 9, wherein the floor is coplanar with a lowermost pair of the wings.

12. The undermount slide bracket defined in claim 9, wherein the gap is between about 0.025 and 0.25 inches in height.

13. The undermount slide bracket defined in claim 9, wherein a lowermost pair of the wings extends farther laterally than an uppermost pair of the wings.

14. The undermount slide bracket defined in claim 11, wherein a lower surface of the foundation is coplanar with the lowermost pair of wings and is flat and devoid of upwardly-directed recesses.

15. The undermount slide bracket defined in claim 10, further comprising a sloping panel that extends forwardly and downwardly from the vertical panel and a stop panel that extends from the sloping panel to the floor.

16. The undermount slide bracket defined in claim 15, further comprising a brace extending between the sloping panel and the lower panel.

17. A method of forming an undermount slide bracket, comprising the steps of:
(a) providing first and second mold halves with respective first and second cavities;

(b) moving the first mold half relative to the second mold half in a first direction so that the first and second cavities form a piece cavity;

(c) injecting polymeric material into the piece cavity to form an undermount slide bracket, the undermount slide bracket comprising:

a vertical panel with upper and lower edges;

a nub extending from a first side of the vertical panel;

a horizontal floor fixed relative to the vertical panel;

two pairs of wings extending forwardly from the floor, each pair of wings extending laterally in opposite directions from a foundation, the pairs of wings being arranged in stacked, spaced apart relationship, such that a gap is formed between vertically adjacent wings;

wherein the foundation has an alternating series of parallel ribs and recesses; and (d) moving the first mold half in a second direction opposite the first direction to remove the undermount slide bracket, the removal of the undermount slide bracket not requiring movement of any portion of the first mold half in a direction perpendicular to the first and second directions.

* * * * *